US007819198B2

(12) United States Patent
Birckhead et al.

(10) Patent No.: US 7,819,198 B2
(45) Date of Patent: Oct. 26, 2010

(54) FRICTION SPRING RELEASE MECHANISM

(76) Inventors: John M. Birckhead, 263 W. Rittenhouse, Houston, TX (US) 77076; Christopher W. Mayeu, 1015 LeGreen, Houston, TX (US) 77009

( * ) Notice: Subject to any disclaimer, the term of this patent is extended or adjusted under 35 U.S.C. 154(b) by 150 days.

(21) Appl. No.: 11/354,767

(22) Filed: Feb. 15, 2006

(65) Prior Publication Data

US 2006/0249285 A1 Nov. 9, 2006

Related U.S. Application Data

(63) Continuation-in-part of application No. 11/146,858, filed on Jun. 7, 2005, now abandoned.

(60) Provisional application No. 60/577,857, filed on Jun. 8, 2004.

(51) Int. Cl.
*E21B 19/16* (2006.01)
*E21B 29/02* (2006.01)

(52) U.S. Cl. ..... 166/377; 166/75.14; 166/83.1; 166/85.5; 166/302; 166/376; 166/381

(58) Field of Classification Search ..... None
See application file for complete search history.

(56) References Cited

U.S. PATENT DOCUMENTS 1,734,186 A 11/1929 Lucien et al.
2,620,815 A 12/1952 Margraf et al.
2,998,018 A 8/1961 Beck et al.
3,618,627 A 11/1971 Wagner
3,638,733 A 2/1972 De Rouville et al.
4,183,371 A 1/1980 Slawson
4,640,354 A * 2/1987 Boisson ..... 166/250.01
4,981,260 A 1/1991 Beiser
5,511,576 A 4/1996 Borland
6,382,234 B1 5/2002 Birckhead et al.
7,114,697 B2 * 10/2006 Millet et al. ..... 251/75

* cited by examiner

*Primary Examiner*—Zakiya W. Bates
(74) *Attorney, Agent, or Firm*—Raymond R. Ferrera; Adams and Reese LLP

(57) ABSTRACT

A one-shot thermally activated release mechanism, the release mechanism including a spiral or helically wound spring wrapped around a set of jaws in a manner that prevents the jaws from expanding; held in this tightened position by two wires, with one wire fixed to the body of a member of the jaws and the second wire attached to the spring, the wires bonded together by a solder or other fusible material. The jaws restrict the movement of a plunger. Heating the solder causes release of the spring and enables expansion of the jaws, allowing movement of the plunger. A bias force on the plunger assists in movement of the plunger past the expanding jaws.

30 Claims, 2 Drawing Sheets

FRICTION SPRING RELEASE MECHANISM

STATEMENT OF RELATED CASES

This application is a continuation-in-part of application Ser. No. 11/146,858, filed Jun. 7, 2005, now abandoned which claims the benefit of U.S. Provisional Application No. 60/577,857, filed Jun. 8, 2004.

FIELD OF THE INVENTION

The present invention relates generally to remotely operated release mechanisms, and more particularly, to a one-shot valve useful for activating well tools or down hole devices.

BACKGROUND OF THE INVENTION

Some previously known well service and completion tools and sub-sea devices were designed to operate utilizing application of hydrostatic pressure. In a typical operation, such tools expose one side of a piston or operating rod to an applied hydrostatic pressure upon receipt of a command, while the opposite side of the piston is held at ambient or lesser pressures. A resulting pressure differential causes the piston or operating rod to move (do work), and this motion causes the desired tool or device actuation or deployment.

For example, in a well working tool such as a packer, when the tool is run into the borehole using wireline, coiled tubing or production tubing, an internal piston working in a cylinder with atmospheric pressure maintained upon either end is provided. As the tool is located in a desired position or depth in the borehole, a valve is actuated upon command to expose one side of the piston or operating rod to hydrostatic well pressure. This causes a differential pressure force to be applied to the piston, which, in turn, causes the piston to move. This force and resulting movement are then mechanically translated to perform various sub-surface functions as desired, such as releasing a tool string, setting a packer, opening or closing a valve, or setting a wire line locking and pack off device.

There is need for a safe, small, simple and reliable remotely operated electrically actuated valve for use in tools such as these mentioned above.

In other previously known tools, pyrotechnic and/or explosive operated valves have been utilized. It should be apparent to one of ordinary skill in the art, however, that explosive valves are inherently dangerous in volatile operating environments, and that replacing an explosive valve with a differential pressure valve would provide a much safer device to transport, or use, in a hazardous environment. The lack of pyrotechnic or explosive substances in a valve would also render the device less subject to regulation by governmental agencies and transportation services.

U.S. Pat. No. 6,382,234 to Birckhead et al. and U.S. Pat. No. 5,511,576 to Borland teach a single-use mechanism in which a small piston is held in place by a solid slug of fusible material. The fusible material must have a large enough cross section to support the force on the piston, and its stroke distance is limited to the piston's length. Increasing the length or cross section increases the thermal mass of the material to be fused, which in turn requires more energy to trigger.

However, there are a number of other applications wherein a heat-activated object of fusible material provides an obstacle to the flow of fluid, which is released when the material is melted. High ambient temperatures, rather than a heating element, generally trigger these devices.

For these and other reasons, it would be desirable to have a single-use command activated valve for activating sub-sea or well working tools that is not triggered by random electrical spikes, electrical fields from equipment, or stray ground current on the floor of an offshore platform. Ideally, such a device would be tolerant of high electrical shocks and mechanical vibrations, and be capable of handling varying loads without prematurely triggering.

SUMMARY OF THE INVENTION

The present invention relates generally to remotely operated mechanisms capable of reliably retaining a rod or plunger subjected to relatively high forces, and releasing the mechanism in a safe and reliable manner by applying a relatively small amount of thermal energy. The invention is especially useful for applications in which a spring-biased or pressure-biased piston or valve must be held in one position, and then freed to move to another position in situations where little power is available, such as the activation of oil well tools or sub-sea devices.

The present invention comprises a novel, single-use, electrically activated release mechanism, ideal for use in well boreholes or sub-seal tools or devices. The device comprises a normally spiral or helically wound spring wrapped around a set of jaws. In the preferred embodiments of the invention, the spring is tightened around the jaws in a manner that prevents the jaws from expanding, and held in this tightened position by two wires. One wire is fixed to the body of a member of the jaws, and the second wire is attached to the spring. The wires are bonded together by a solder or other fusible material.

The wires hold the spring in its wound or compressed state, which in turn holds the jaws in place. The jaws provide a restriction that prevents a plunger from moving past the jaws. When a heating element placed near the solder joint is heated, the solder softens, allowing the two wires to separate and the spring to expand to its relaxed condition. This allows the jaws' restriction to expand, and allows the plunger to stroke through a bore past the jaws, assisted by spring or pressure bias.

A single-use release mechanism is provided, wherein the release mechanism includes a clamping means having a circumferential restriction state and a non-restriction state, providing circumferential restriction about a member load; a spiral tensioning means having a wound state and an unwound state; a first attachment means whereby the wound state of the spiral tensioning means places the clamping means in the restriction state and the unwound state of the spiral tensioning means places the clamping means in the non-restriction state; and a holding means whereby the spiral tensioning means is held in the wound state.

Also provided is a one-shot, thermally activated release mechanism, wherein the release mechanism includes a normally spiral or helically wound spring wrapped around a set of jaws in a manner that prevents the jaws from expanding. The jaws are then held in this tightened position by two wires, with one wire fixed to the body of a member of the jaws and the second wire attached to the spring, and the wires being bonded together by a solder or other fusible material.

Also provided is a single-use release mechanism, which operates only one time upon activation, wherein the release mechanism includes a set of movable jaws held closed by a power spring, the movable jaws having a bore disposed therethrough, and a restriction capable of preventing a plunger member from passing through the closed jaws, holding the plunger member in a first position. At least one means for force-biasing the movable plunger member to a second position if the power spring is expanded, thereby opening movable jaws and ceasing the restriction. An electrical release means holds the spring closed, thereby holding the movable jaws closed as well, thereby keeping the movable plunger in the first position and immovable against the force biasing means and, upon electrical activation, releasing the movable plunger member in response to the force biasing means, finally moving the movable jaws to an open position.

Also provided is a one-shot, thermally activated, release mechanism, wherein the release mechanism includes a normally spiral or helically wound spring wrapped around a frame containing restriction balls, which act to restrict the movement of a plunger.

Also provided is a friction spring release mechanism having a spring, wherein a least one wire holds the spring in a compressed state, while the device's jaws are held in a restricted state by the spring. The device also includes a plunger, and jaws that restrict its movement, thereby preventing the plunger from moving past the jaws. The device also imparts a pressure bias on the plunger, and a heating element, such that the wire may be separated, thereby releasing the spring from a compressed state, and executing the following steps. A method operating the device includes: heating the wire, thereby releasing the spring from the compressed state, releasing the jaws from the restriction state, removing the restriction on the plunger, and applying the pressure bias on the plunger, thereby assisting the plunger's movement past the jaws.

OBJECTS AND ADVANTAGES OF THE INVENTION

The present invention provides numerous desirable features. Release mechanism actuation may be initiated on-command from an electrical source. Short duration electrical spikes or stray ground currents will not accidentally actuate the release mechanism. The release mechanism actuates one time and remains actuated regardless of additional electrical inputs. The release mechanism has a small size, suitable for downhole and subsea uses. The release mechanism operates reliably at temperatures up to 450° Fahrenheit. The release mechanism is safe to handle and to transport. Required actuation power is low and suitable for battery driven operations.

In addition, there are at least two main advantages of this invention over other prior trigger release mechanisms. First, the release mechanism is held in place and prevented from spreading by the tightened spring. The large surface area of the spring layers presents a significant friction force, which dominates the holding force for the release mechanism. As the force from the release mechanism increases, the friction force also increases. The effect of this friction force is that the force required to hold the release mechanism in its unreleased position is small and fairly constant, regardless of load. This means that a low power trigger may be used, even when force greatly varies.

A further advantage over other release mechanisms is that the present invention has a positive release, even when the load on the release mechanism is light or non-existent. In many release mechanisms, the force required to release a device comes from the load, and for light loads a device may not release cleanly. Once the spring of the present invention is released, it unwinds, a layer at a time, whether the release mechanism is loaded or not. This allows the spring to have almost no practical limit to the number of layers, which allows the release mechanism to work with large, greatly varying loads, while remaining held in place with a relatively very small force and assuring a clean release.

REFERENCE NUMERALS IN THE DRAWINGS

Figure 3:
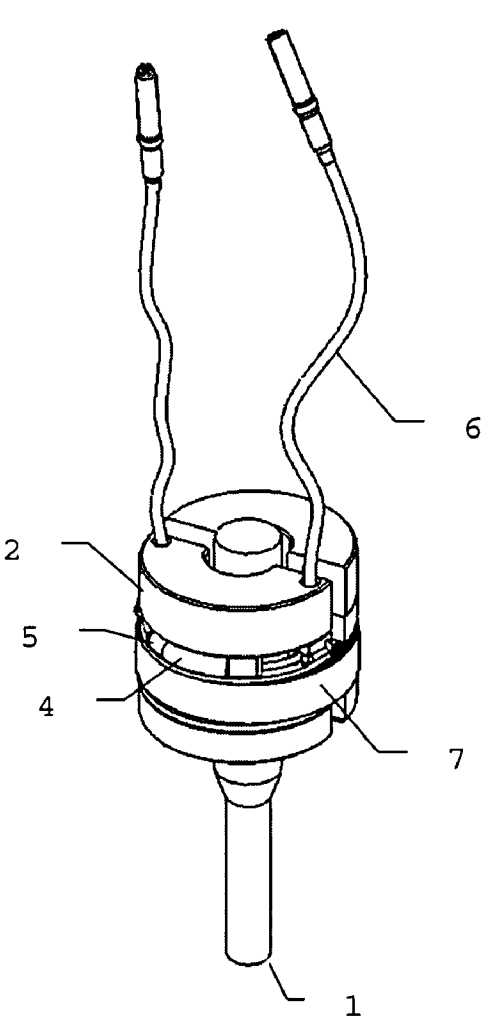
FIG. 3 is a perspective view of the release mechanism, after actuation.

The following elements are numbered as described in the drawings and detailed description of the invention:

| | |
|---|---|
| 1 plunger | 2 jaw assembly |
| 3 wire | 4 meltable material |
| 5 heating elements | 6 connecting wires |
| 7 spring | 8 balls |
| 9 coiled spring | 10 frame |

DETAILED DESCRIPTION OF THE DRAWINGS

Figure 2:
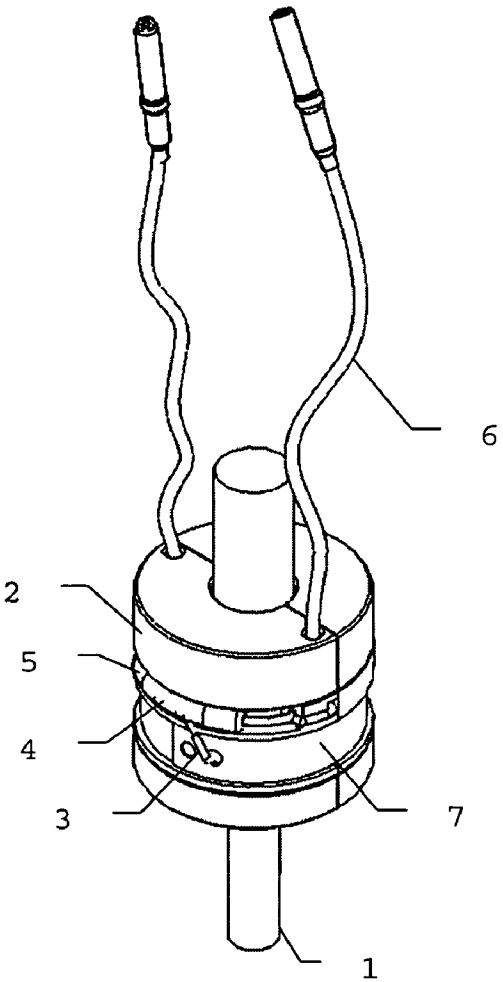
FIG. 2 is a perspective view of the release mechanism with the plunger installed.
Figure 1:
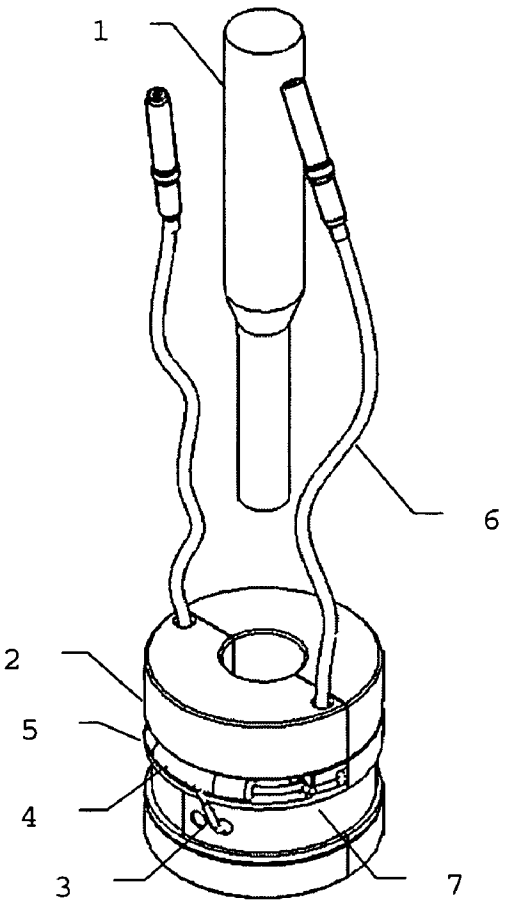
FIG. 1 is a perspective view of the release mechanism and accompanying plunger in accordance with the present invention.

Referring now to FIGS. 1 and 2, a presently preferred embodiment of a release mechanism according to the invention is shown in perspective. In this particular embodiment, the release mechanism is shown in an unactuated position, and the release mechanism is configured to actuate only one time and thereafter remain open.

In a detailed, though non-limiting embodiment, the release mechanism comprises a generally flat, spiral wound spring 7, which is tightly wound around segmented jaw assembly 2 and held in a tightly wound state by wire 3. Wound spring 7 may be any of a variety of relatively flat, spirally or helically wound springs, and provide a tensioning means having a wound state and an unwound state. Likewise, jaw assembly 2 may comprise any of a wide variety of devices having a clamping means, so long as it provides circumferential restriction about an object. Examples include, but are not limited to, a clamp, a chuck, three-jaw chucks, four-jaw chucks, self-centering chucks or jaws, and similar devices.

In other embodiments, wire 3 is attached to spiral wound spring 7 and held by a meltable material 4 disposed between heating elements 5, thereby providing a holding means so as to hold spring 7 in a wound state. Wire 3 may be any of a variety of materials exhibiting adequate tensile strength and capable of attaching to meltable material 4. Wire 3 may be expressed in any of a variety of shapes, such as wire or ribbon shaped.

In further embodiments, meltable material 4 is held in a fixed position relative to wound spring 7 by attaching a second wire (not shown), or by otherwise affixing a meltable material 4 to jaw assembly 2, or instead to heating elements 5. Meltable material 4 may be any of a variety of materials capable of melting or separating from wire 3 when heated. Examples include, but are not limited to, a solder joint, a metallic solder, an alloy solder, or a meltable or decomposable plastic. Preferably, meltable material 4 will separate from wire 3 at a temperature in a range between about 500° Fahrenheit and about 1,000° Fahrenheit. In a presently preferred embodiment, meltable material 4 is a metallic solder made of an alloy that exhibits a relatively high creep resistance at high temperatures.

In a still further embodiment, heating elements 5 comprise any of a variety of materials that exude heat in response to electrical current. In one particular embodiment, for example, heating elements 5 comprise a resistance coil wound adjacent to a meltable material 4. Connecting wires 6 attach to heating elements 5.

In FIG. 1, member load plunger 1 is shown oriented prior to insertion into jaw assembly 2. Plunger 1 is shaped so as to be received by jaw assembly 2. In this embodiment, plunger 1 is cylindrically shaped with a conical seat to receive the circumferential restriction force exerted by jaw assembly 2.

FIG. 2 illustrates plunger 1 as inserted into jaw assembly 2. An axial force (not illustrated) is externally applied to plunger 1 to urge it through the center of segmented jaw assembly 2. This axial force may be applied by a spring, hydrostatic or other force that is constantly applied. Plunger 1 is prevented from passing through segmented jaw assembly 2 by the restriction of segmented jaw assembly 2, which is further held rigidly in place by spirally wound spring 7.

FIG. 3. illustrates the release mechanism in its actuated, open or unwound state. Electrical current is applied to connecting wires 6, providing power to resistive heating elements 5. Meltable material 4 melts, thereby releasing wire 3, allowing spiral wound spring 7 to expand to a relaxed shape. Segmented jaw assembly 2 is free to move, and the conical profile on plunger 1 assists segmented jaws 3 to spread, allowing the axial force to push plunger 1 through the restriction. The movement of plunger 1 may be used to shift a valve, to set a packer, to release dogs in a tool string, or be otherwise attached to a variety of devices ready to be actuated.

In operation, wires 3 hold spring 7 in its wound or compressed state, which in turn holds jaw assembly 2 in place. Jaw assembly 2 provides a restriction that prevents a plunger 1 from moving past jaw assembly 2. When heating element 5, which is placed near meltable material 4, is heated, meltable material 4 softens, allowing wires 3 to separate and spring 7 to expand to a relaxed condition. This allows jaw assembly 2 to expand, allowing plunger 1 to stroke through a bore past jaw assembly 2, which may be assisted by a spring or other axial pressure bias.

Figure 5:
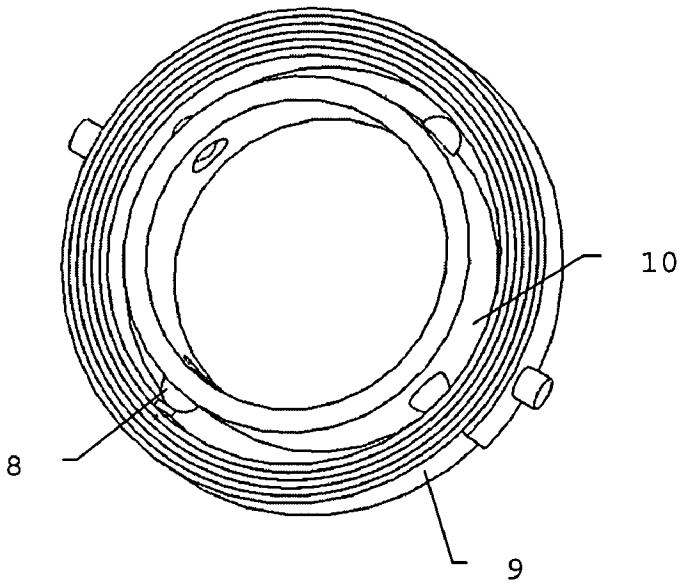
FIG. 5 is a perspective view of the alternate embodiment of the release mechanism shown in FIG. 4, after actuation.
Figure 4:
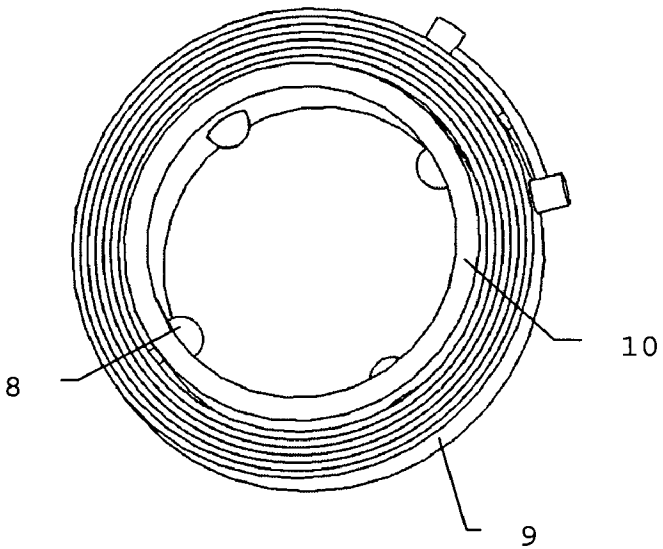
FIG. 4 is a perspective view of an alternate embodiment of the release mechanism.

FIG. 4 and FIG. 5 show an alternate embodiment of the present invention using balls to provide circumferential restriction. Balls 8 are held in position by a circumferential frame. The circumferential frame 10 may be shaped so as to receive a plunger (not illustrated). As illustrated in FIG. 4, tightly coiled spring 9 exerts pressure on balls 8, pushing balls 8 to the interior of frame 10, thereby forming a restriction to a plunger. As illustrated in FIG. 5, upon release of spring 9, the balls recede into frame 10 and the restriction is cleared, allowing a plunger or other device to pass through the opening.

In operation, wires 3 hold spring 9 in its wound or compressed state, which in turn holds balls 8 inward. Balls 8 provide a restriction that prevents a plunger 1 from moving past balls 8. When heating element 5, which is placed near meltable material 4, is heated, meltable material 4 softens, allowing wires 3 to separate and spring 9 to expand to a relaxed condition. This allows balls 8 to recede, allowing plunger 1 to stroke through a bore past balls 8, which may be assisted by a spring or other axial pressure bias.

The foregoing description is intended primarily for illustrative purposes, and is not intended to include all possible aspects of the present invention. Moreover, while the invention has been shown and described with respect to a presently preferred embodiment, those of ordinary skill in the art will appreciate that the description, and various other modifications, omissions and additions, so long as in the general form and detail, may be made without departing from either the spirit or scope thereof.

The invention claimed is:

1. A single-use release mechanism comprising:

a) a clamping means having a circumferential restriction state and a non-restriction state, providing circumferential restriction about a member load;

b) a spiral tensioning means having a wound state and an unwound state, wherein said wound state places said clamping means in said restriction state and said unwound state places said clamping means in said non-restriction state; and c) a holding means whereby said spiral tensioning means is held in said wound state.

2. The mechanism of claim 1, wherein said holding means comprises at least one wire attached to said spiral tensioning means and a meltable material attached to said at least one wire.

3. The mechanism of claim 2, wherein said holding means further comprises a resistance coil located proximate to said meltable material.

4. The mechanism of claim 1, wherein said holding means comprises at least one wire attached to said spiral tensioning means and a meltable solder joint attached to said at least one wire.

5. The mechanism of claim 4, wherein said meltable solder joint comprises a metallic alloy with relatively high creep resistance at elevated temperatures.

6. The mechanism of claim 4, wherein said meltable solder joint has a melting temperature in a range between about 500° Fahrenheit to about 1000° Fahrenheit.

7. The mechanism of claim 1, further comprising a force biasing means disposed upon the member load.

8. The mechanism of claim 7, wherein said force biasing means comprises a spring force means.

9. The mechanism of claim 7, wherein said force biasing means comprises a hydrostatic pressure force means.

10. The mechanism of claim 1, wherein said clamping means comprises movable jaws.

11. The mechanism of claim 10, wherein said movable jaws further comprises movable balls captured within a frame.

12. The mechanism of claim 10, wherein said movable jaws further comprises a segmented frame and a segmented conical section, wherein said segmented conical section is approximately shaped to receive a conical section disposed on the member load.

13. The mechanism of claim 1, used to shift a valve.

14. The mechanism of claim 13, wherein said valve is used to set a packer.

15. The release mechanism of claim 1, used to release dogs in a toolstring.

16. The mechanism of claim 1, wherein said clamping means comprises a frame, a plurality of balls received by said frame, said balls providing circumferential restriction about said member load.

17. A one-shot thermally activated release mechanism comprising:

a) a set of jaws;

b) a spring wound around said set of jaws;

c) a meltable material;

d) a first wire;

e) a first end of said first wire affixed to said spring, and a second end of said first wire affixed to said meltable material;

f) a second wire;

g) a first end of said second wire affixed to said meltable material, and a second end of said second wire affixed to said jaws; and h) a heating element disposed proximate to said meltable material.

18. The mechanism of claim 17, wherein said meltable material is a meltable solder joint.

19. The mechanism of claim 17, wherein said meltable material comprises a metallic alloy having a relatively high creep resistance at elevated temperatures.

20. The mechanism of claim 17, wherein said meltable material has a melting temperature in a range between about 500° Fahrenheit to about 1000° Fahrenheit.

21. The mechanism of claim 17, wherein said heating element further comprises a resistance coil located disposed proximate to said meltable material.

22. The mechanism of claim 17, further comprising a force biasing means disposed upon said set of jaws.

23. The mechanism of claim 22, wherein said force biasing means comprises a member load and a spring force means.

24. The mechanism of claim 22, wherein said force biasing means comprises a member load and a hydrostatic pressure force means.

25. The mechanism of claim 17, wherein said set of jaws further comprises a segmented frame and a segmented conical section, wherein said segmented conical section is approximately shaped to receive a conical section disposed upon a member load.

26. The mechanism of claim 17, used to shift a valve.

27. The mechanism of claim 26, wherein said valve is used to set a packer.

28. The release mechanism of claim 17, used to release dogs in a toolstring.

29. The mechanism of claim 17, wherein said set of jaws comprises a frame, a plurality of balls received by said frame, wherein said balls provide circumferential restriction about a member load.

30. A method of releasing a one-shot member load using a thermally activated release mechanism having a spring, a least one wire holding said spring in a compressed state, jaws held in a restriction state by said spring, a plunger, said jaws providing restriction to said plunger, preventing said plunger from moving past said jaws, a pressure bias on said plunger, and a heating element, wherein said at least one wire may be separated, thereby releasing said spring from the compressed state, the method comprising the steps of:

a) heating said at least one wire;

b) releasing said spring from the compressed state;

c) releasing said jaws from the restriction state;

d) removing the restriction on said plunger; and e) applying said pressure bias on said plunger, thereby assisting said plunger to move past said jaws.

* * * * *